US005240071A

United States Patent [19]

Shaw, Jr. et al.

[11] Patent Number: 5,240,071

[45] Date of Patent: Aug. 31, 1993

[54] IMPROVED VALVE ASSEMBLY APPARATUS USING TRAVELLING ISOLATION PIPE

[76] Inventors: C. Raymond Shaw, Jr., 507 Bonnie Dr.; David L. Farley, 415 Woodvale, both of Lafayette, La. 70503

[21] Appl. No.: 911,983

[22] Filed: Jul. 10, 1992

Related U.S. Application Data

[63] Continuation-in-part of Ser. No. 801,958, Dec. 2, 1991, which is a continuation-in-part of Ser. No. 693,679, Apr. 30, 1991, Pat. No. 5,137,088.

[51] Int. Cl.[5] ..... E21B 34/00

[52] U.S. Cl. ..... 166/319; 166/55

[58] Field of Search ..... 166/319-326, 166/332-334, 55, 55.1, 55.2

[56] References Cited

U.S. PATENT DOCUMENTS

| | | | |
|---|---|---|---|
| 2,545,504 | 3/1951 | Villafane | 166/4 |
| 2,565,731 | 8/1951 | Johnston | 164/0.3 |
| 2,626,177 | 1/1953 | Maxwell et al. | 294/86 |
| 2,855,943 | 10/1958 | Moller et al. | 137/70 |
| 3,024,846 | 3/1962 | Gage | 166/226 |
| 3,599,713 | 8/1971 | Jenkins | 166/244 |
| 3,831,680 | 8/1974 | Edwards et al. | 166/311 |
| 4,512,406 | 4/1985 | Vann et al. | 166/318 |
| 4,651,827 | 3/1987 | Helderle | 166/317 |
| 4,658,902 | 4/1987 | Wesson et al. | 166/319 |
| 4,691,775 | 9/1987 | Lustig et al. | 166/317 |
| 4,911,242 | 3/1990 | Hromas et al. | 166/319 |
| 4,957,167 | 9/1990 | Schultz | 166/319 |
| 5,101,904 | 4/1992 | Gilbert | 166/319 |
| 5,109,925 | 5/1992 | Stepp et al. | 166/317 |
| 5,137,088 | 8/1992 | Farley et al. | 166/318 |
| 5,156,207 | 10/1992 | Haugen et al. | 166/319 X |

*Primary Examiner*—Thuy M. Bui

*Attorney, Agent, or Firm*—Pravel, Hewitt, Kimball & Krieger

[57] ABSTRACT

A travelling valve assembly utilizing a length of tubing, longer than the production screen, positioned at the end of a wash pipe and lowered into the tubing bore so that the lower end of the tubing is a depth below the production screen. When gravel packing is concluded, the tubing is then placed in position by raising the wash pipe and tubing to the upper seal bore. The wash pipe is then sheared from the tubing assembly. The tubing includes seals at each end, which seat in respective seal bores, for sealing off above and below the production screen. There is further provided a valving mechanism, such as a sliding door valve which is operable from the surface between open and closed positions. While the valving mechanism is closed, the production flow is prevented; however, upon opening the valve through a wire line or shifting tool, production flows through the sliding door valve and up to the surface through the tubing. In an additional embodiment, rather than include a valve in the wall of the tubing, a mechanical perforator would be lowered into the tubing and mechanically perforate the wall of the tubing for allowing the production to commence. An yet another embodiment, rather than using an isolation pipe member suspended from the valve assembly, there would be included the second length of tubing such as wash pipe, suspended from the assembly.

13 Claims, 14 Drawing Sheets

IMPROVED VALVE ASSEMBLY APPARATUS USING TRAVELLING ISOLATION PIPE

This is a continuation-in-part application of U.S. patent application, Ser. No. 07/801,958, filed Dec. 2, 1991, entitled "Improved Up and Down Travelling Disc Valve Apparatus", by inventors David Farley and Kent T. Fink, presently pending, which was a continuation-in-part application of U.S. patent application, Ser. No. 07/693,679, filed Apr. 30, 1991, entitled "Travelling Disc Valve Apparatus", by the same inventors, now U.S. Pat. No. 5,137,088.

BACKGROUND OF THE INVENTION

1. Field of the Invention

The apparatus of the present invention relates to downhole valves. More particularly, the present invention relates to a disc valve, constructed of a breakable material, such as glass, positioned in the flow bore of a tubing string that prevents flow of fluid through the bore from either direction. When flow is desired, the breakable disc is ruptured, and the flow is allowed to commence within the bore. In an additional embodiment, the disc valve assembly would be sheared free from the wash pipe and pushed to a position below the telltale screen so that the opening for production would be substantially larger than with the first embodiment. Furthermore, in yet an additional embodiment, an isolation pipe would be engaged to the wash pipe for isolating the formation for production to commence. It is this particular embodiment which is the focus of this application.

2. General Background

In the general process for drilling and production of oil and gas wells, at that point in the process where a hydrocarbon formation has been located at a particular depth, normally an exterior casing would be lowered down the bore hole through the area of production, known as the production zone. The exterior casing is perforated with the use of a perforating gun or the like. Using electric wire line and setting tools, or some other means, a permanent type packer, referred to as a "sump packer" is usually set below the perforations. Subsequently, an internal tubing string, together with sand screen and blank pipe, packer and packer extension, hydraulic setting tool, cross-over tool, and wash pipe, are positioned within the exterior casing to engage with the "sump packer". The annulus between the sand screen and the exterior perforated casing is packed off, utilizing certain procedures. This packing off is necessary so that the interior tubing would be utilized to carry the recovered hydrocarbons to the surface. The area around the perforations is prepared, so that the flow of hydrocarbons may commence.

For example, the well must be gravel packed, so that the flow of sand or the like out of the formation is prevented during recovery of the hydrocarbons. The present invention would be utilized following the gravel packing procedure, with the assignee company, Completion Services, Inc., would designate as the "Complete Gravel Pack," which would include a hydraulic setting tool and crossover being run into the well with the required sand screen and blank pipe. The packer assembly would be seated using pump pressure applied to the tubing. After it is seated, the crossover valve may be opened and closed. With the crossover valve closed, the packer may be pressure tested by pumping down the casing. Fluid may be pumped into the formation to establish injection rate. Also, the formation may be acidized, if necessary. With the crossover valve open, sand slurry may be circulated to place sand outside of the screen and into the formation until adequate gravel pack is obtained. After removal of the setting tool and crossover, a production seal assembly is run in for production of the zone.

After gravel packing is complete, oftentimes the well may not necessarily be pressure balanced. The formation, under these conditions, may tend to absorb the well fluid into the production zone or the fluid in the zone may tend to flow into the well. In either case, this could lead to unacceptable (a) loss of expensive well fluid, (b) damage to the formation, (c) danger of a potential well blow-out or co-mingling of formation fluids. In the present state of the art, if there can be a prediction in which direction the pressure differential will exist within the well, a flapper valve can be utilized which would hold pressure in one direction only. However, flapper valves can be easily damaged, activated premature, leak or rupture at too low a pressure differential. Therefore, there is a need in the art for a valve which would prevent the movement of fluids within the well bore in either direction, and under varying degrees of pressure differential within the well. There have been patents issued in the art which relate to valves in operation downhole, during the recovery of hydrocarbons during production, etc., the most pertinent being as follows:

| PATENT NO. | TITLE | ISSUE DATE |
|---|---|---|
| 4,658,902 | "Surging Fluids Downhole In An Earth Borehole" | Apr. 21, 1987 |
| 4,651,827 | "Hydraulically Controlled Safety Valves For Incorporation In Production Tubes Of Hydrocarbon Production Wells" | Mar. 24, 1987 |
| 4,691,775 | "Isolation Valve With Frangible Flapper Element" | Sep. 8,1987 |
| 3,831,680 | "Pressure Responsive Auxilaiary Disc. Valve And The Like For Well Cleaning, testing And Other Operations" | Aug. 27, 1974 |
| 3,599,713 | "Method And Apparatus For Controlling The Filling Of Drill Pipe Or The Like With Mud During Lowering Thereof" | Aug. 17, 1971 |
| 3,024,846 | "Dual Completion Packer Tool" | Nov. 15, 1957 |
| 2,855,943 | "Circulation Port Assemblies For Tubing Or Well Pipe" | Oct. 14, 1958 |
| 2,626,177 | "Tool For Hydraulically Displacing Well Materials" | Jan. 20, 1953 |
| 2,565,731 | "Disk Perforator For Pipes In Wells" | Aug. 28, 1951 |
| 2,545,504 | "Completion Shoe" | Mar. 20, 1951 |

Other objects of the invention will be obvious to those skilled in the art from the following description of the invention.

SUMMARY OF THE PRESENT INVENTION

The apparatus of the present invention solves the problems in the art in a simple and straightforward manner. What is provided is a length of tubing, longer than the production screen, positioned at the end of a wash pipe and lowered into the tubing bore so that the lower end of the tubing is a depth below the production screen. When gravel packing is concluded, the tubing is then placed in position by raising the wash pipe and tubing to the upper seal bore. The wash pipe is then sheared from the tubing assembly. The tubing includes seals at each end, which seat in respective seal bores, for sealing off above and below the production screen. There is further provided a valving mechanism, such as a sliding door valve which is operable from the surface between open and closed positions. While the valving mechanism is closed, the production flow is prevented; however, upon opening the valve with a wire line shifting tool, production flows through the sliding door valve and up to the surface through the tubing.

Therefore, it is a principal object of the present invention to provide an embodiment of the travelling disc valve assembly where a length of tubing is positioned with the assembly to undertake the valving function during production;

It is a further object of this embodiment of the present invention to provide a length of tubing secured to the valve assembly wherein a valving mechanism, such as a sliding side door valve may allow flow from the formation after sealing off above and below the production screen;

It is still a further object of the present invention to use a tubing secured within the bore of the housing, so that debris may fall through to the space below the sump packer, and not affect the operation of the production flow;

It is a further object of the present invention to provide a valving mechanism during production flow which may be re-closed after production to re-isolate the production zone for future use; and It is a further object of the present invention to provide an embodiment of the travelling disc valve assembly where a length of tubing is engaged to the assembly so as to seal off the production zone, so that when production is to commence a mechanical perforating tube may perforate the wall of the tubing and allow flow of product for production of the well.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1A:
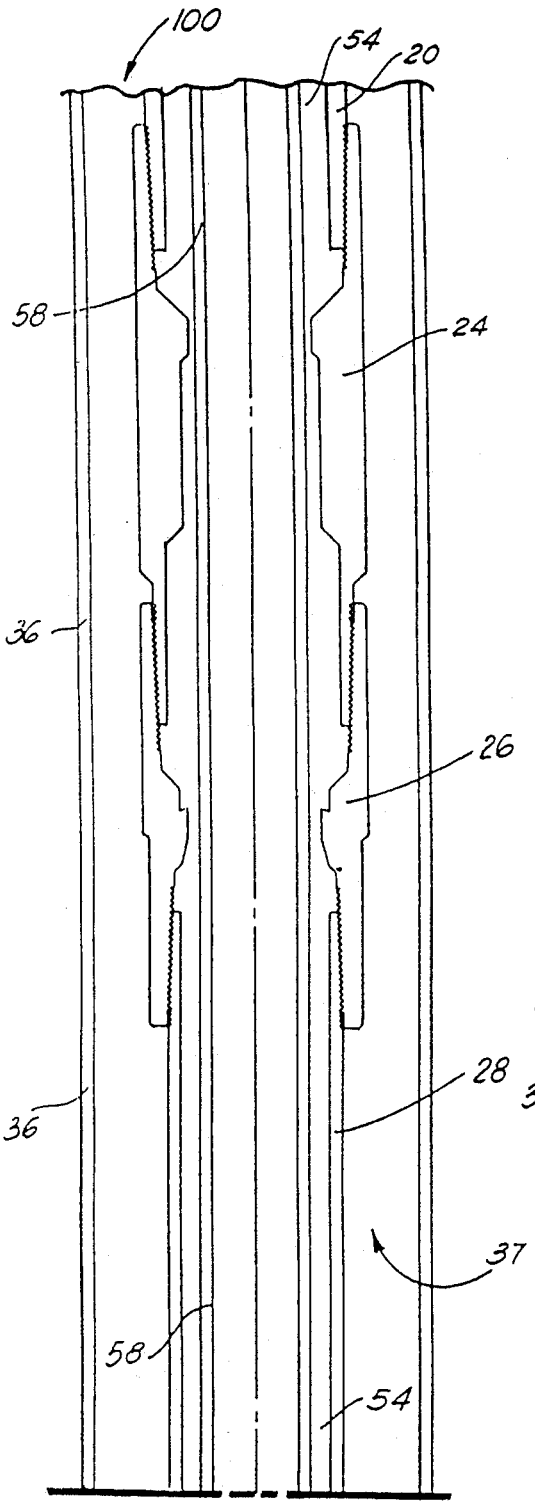
FIGS. 1A through 1G illustrated cross-section views of isolated components making up the upper and lower sections of the lower circulation configuration utilizing the present invention.

The apparatus of the present invention referred to as a travelling disc valve is illustrated in the figures by the numeral 10. As best seen in the drawings, the entire assembly housing the travelling disc valve assembly during lower circulation is shown in FIGS. 1A through 1G. The upper 1D section of the assembly is illustrated in FIGS. 1A through 1D, and the lower section of the assembly illustrated in FIGS. 1E through 1G.

Figure 1B:
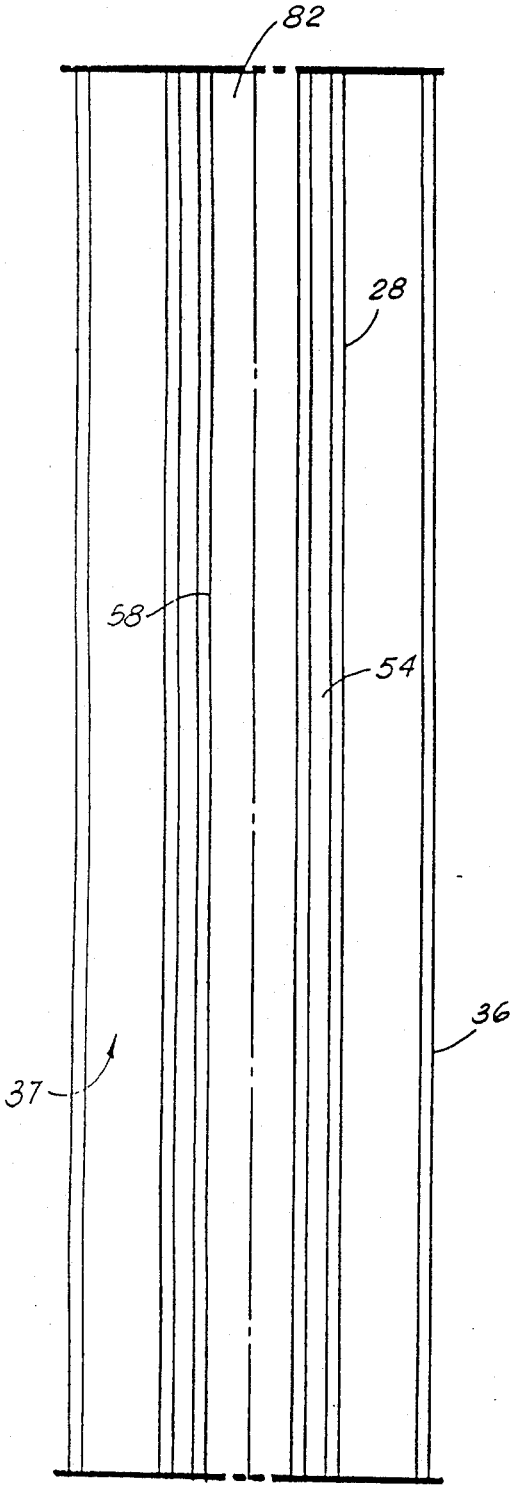
Figure 1C:
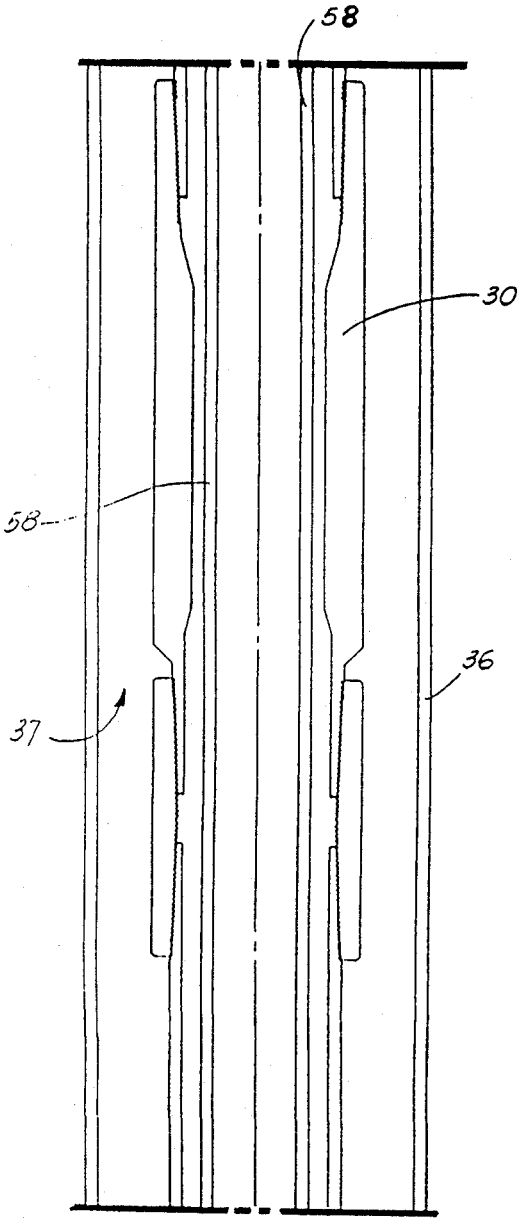
Figure 1D:
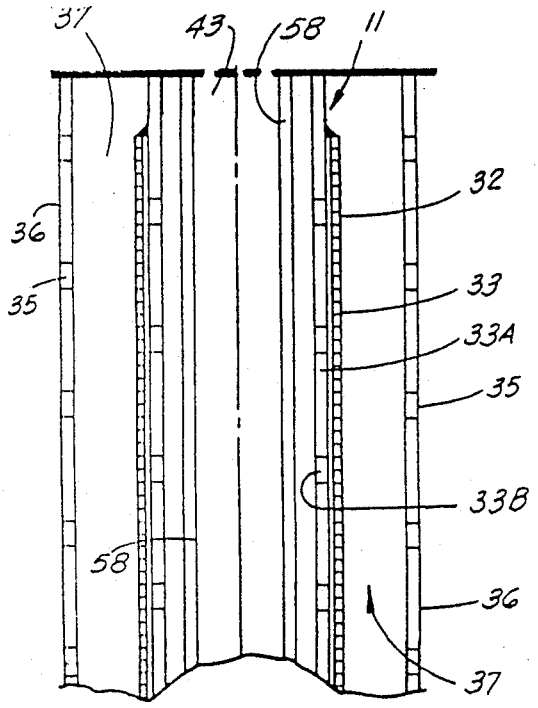
Figure 1E:
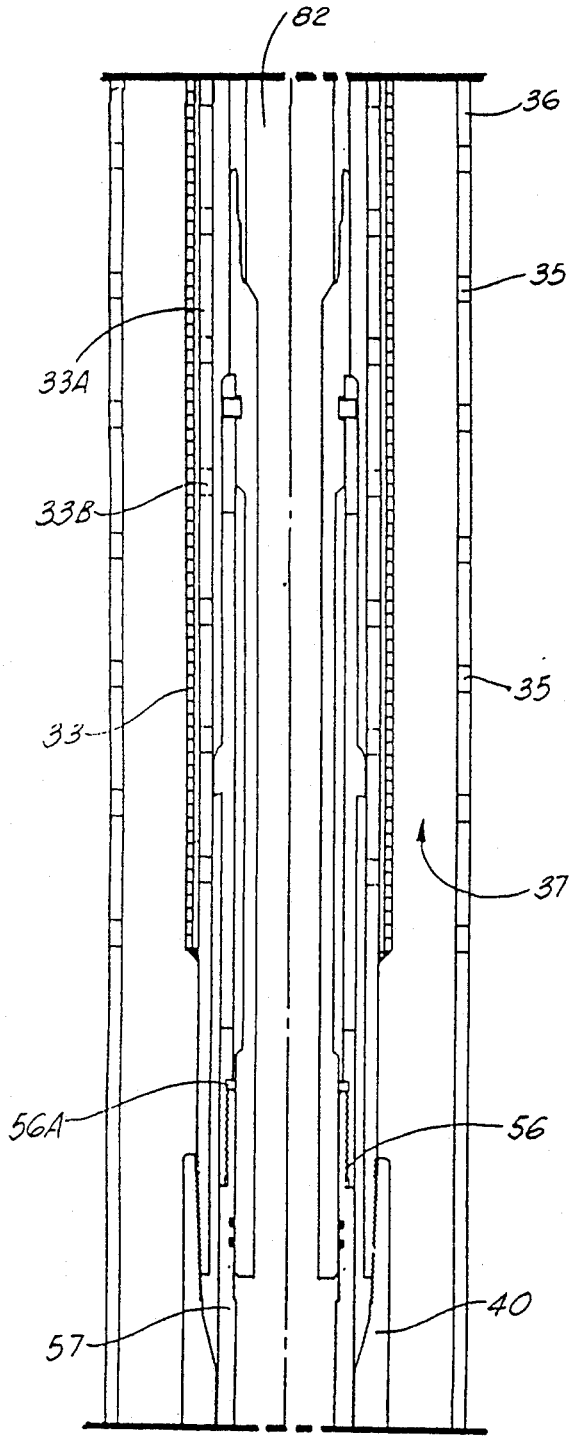
Figure 1F:
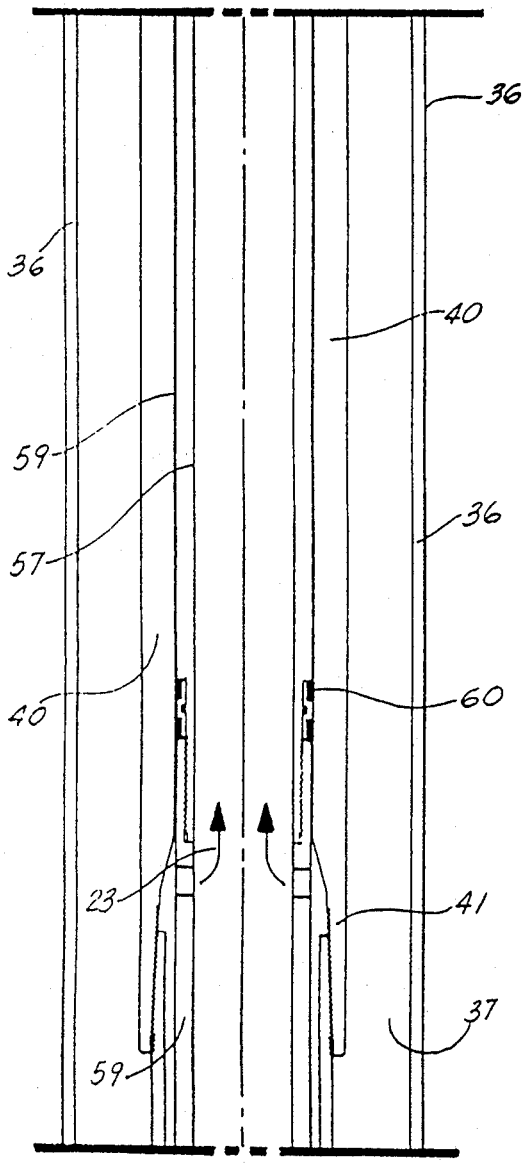
Figure 1G:
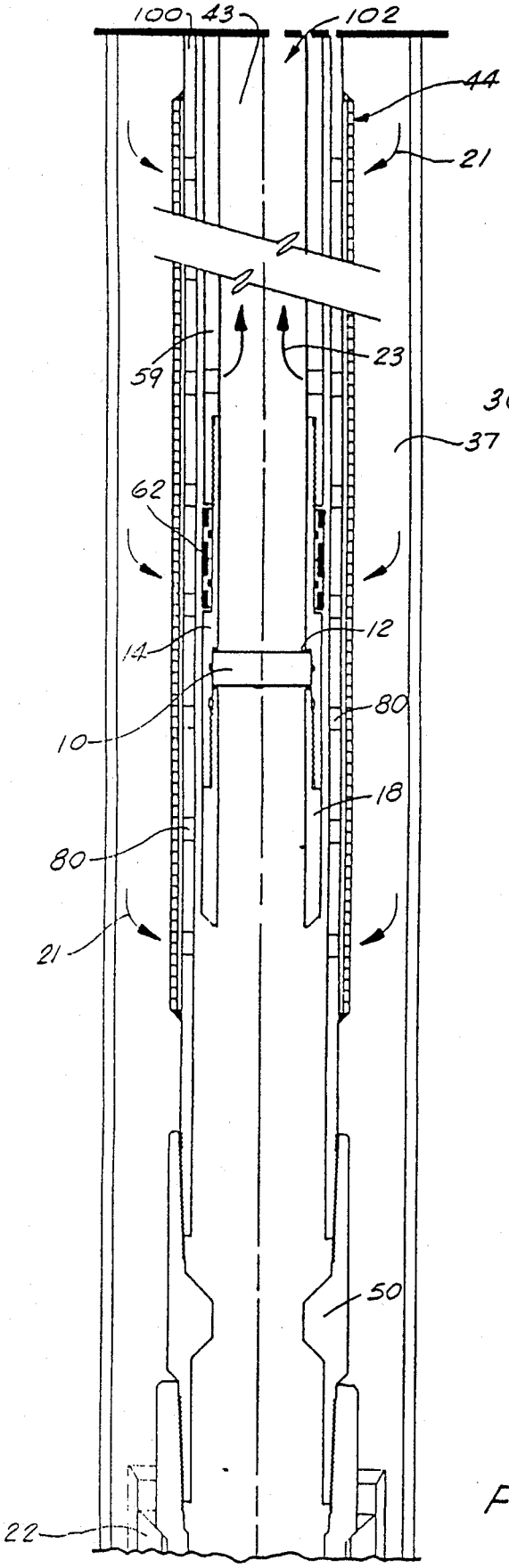
Figure 1H:
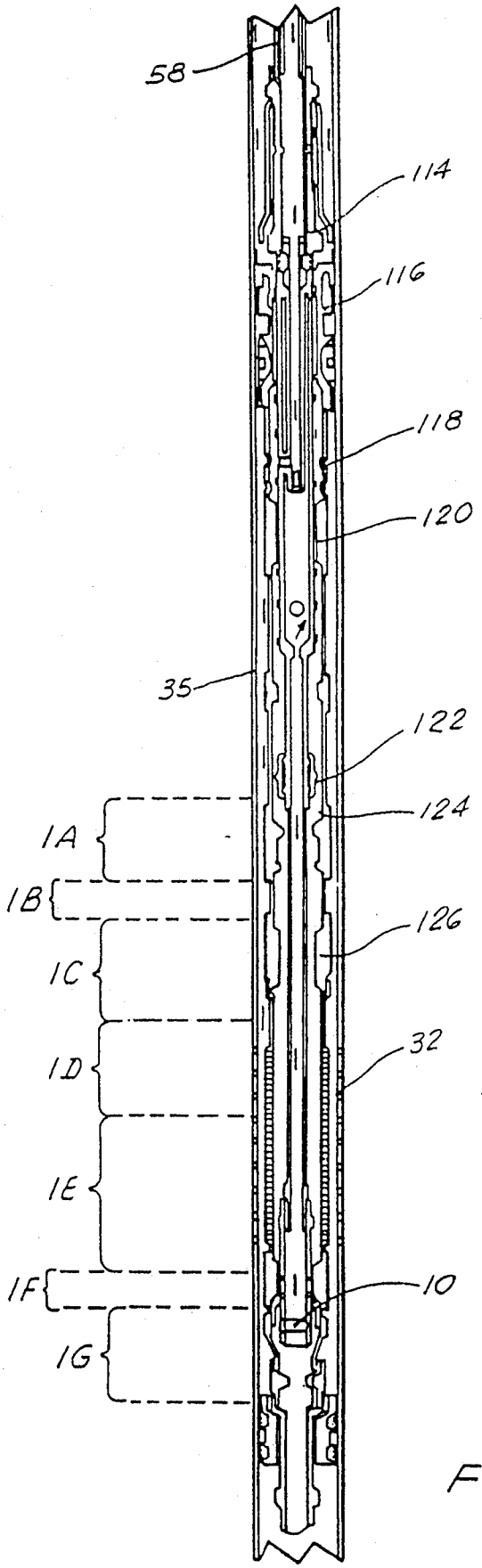
FIG. 1H is an overall view of the components of the assembly as illustrated in FIGS. 1A through 1G, including the components in the tubing string situation directly above the assembly components that are illustrated in FIG. 1H.

In FIG. 1H there is illustrated an overall composite view of the disc valve assembly as seen in its isolated components in FIGS. 1A through 1G, and the components in the tubing string positioned directly above the disc valve assembly. These would comprise upper setting tool and crossover assembly 114, with the compset packer 116 positioned directly below. Furthermore, there is illustrated the perforated extension 118, which is attached directly to the seal bore 120, which is positioned directly below the perforated extension 118. Furthermore, there is illustrated the indicator collet 122, and the no-go housing 124 for the disc valve 10. Directly below the no-go housing for the disc valve is a seal bore 126 for the disc valve 10, and thence the production screen 32 as illustrated in the isolated views, the top seal bore member 30, and thence the disc valve assembly 10 as will be discussed further.

As seen in FIG. 1G, travelling disc valve 10 comprises a solid piece of material, preferably glass, which may be of various thicknesses depending on the pressures downhole that may be encountered and various diameters depending on the size of the tubing in which the disc valve 10 is positioned. Disc 10 is positioned within a groove 12 in the wall of a collet member 14, as illustrated in FIG. 1G. Groove 12 is formed on its lower end by a circular end piece 18 threadably secured on the lower end of collet 14 which serves as the lower shoulder upon which the disc valve 10 rests in groove 12.

Turning now to the system in which travelling disc valve 10 functions, reference is made to FIGS. 1A–1G, which comprise a series of isolated views of the system, extending from the upper packer extension 20 down to the lower most component, the sump packer 22. As seen in the FIGS. 1A through 1D, the packer extension 20 is threadably engaged to a top locator 24 which engages on its lowermost end a collet locator 26. The collet locator 26 interconnects to an elongated spacer 28, which, at its lower end engages the top seal bore member 30, to which bank tubing and the production screen 32 is suspended. Production screen 32, as illustrated in FIG. 1E would be a typical production screen having an outer screen layer 33, positioned around the screen support wall 33A. The support wall 33A would include a plurality of ports 33B so that production flow through the ports 35 in the wall of the production casing 36 into the annulus 37 of the production casing 36, would flow into the internal bore of the production screen and up to the surface as will be described further. As seen in FIGS. 1D and 1E, when production is commenced the hydrocarbon flow would move through the perforations in the wall of casing 36, into the annulus between the wall of casing 36 and the production screen 32, and then to the surface through the bore in the production string.

As seen further in FIGS. 1E through 1G, the lower end of production screen 32 would be connected to a bottom seal bore 40, for connecting to, at its lower end 41, a second screen, or a telltale screen 44, which would be connected to a bottom locator 50 and then to the lowest component, the sump packer 22, which would pack off the lowest most point of the assembly so that fluid or production flow could not pass that point during production.

As is illustrated in FIGS. 1A–1G, the components previously recited, referred collectively hereinafter as outer production assembly 100, further comprise a continuous internal bore 54 therethrough, in which there is housed the internal system for carrying the travelling disc valve 10, and will be referred to as the travelling disc valve assembly 102. Continuing to refer to FIGS. 1A through 1G, the assembly 102 would comprise an upper length of wash pipe 58 extending down the internal bore 54 of the outer assembly 100, and would extend and interconnect to a shear joint 56 the lower end of which would interconnect to a collet 57. The collet 57 would further include a first top seal ring 60 which would form a seal between the outer wall 59 of collet 57 and the inner wall of bottom seal bore member 40, to prevent fluid flow therebetween. Further, as seen in FIG. 1G, collet 57 would further interconnect to a spacer 59 which would in turn interconnect to second bottom seal rings 62 again for sealing against fluid flow as will be discussed further. Directly positioned below second bottom seal rings 62 traveling disc valve member 10, as discussed earlier. As seen in the Figures, during the process of lower circulation, the travelling disc valve 10 is positioned along the length of telltale screen 44, to prevent the travelling disc valve from interfering with lower or upper circulation.

Having discussed the components of the system, as illustrated in the Figures, a discussion will be had regarding the function of the travelling disc valve 10 in the system, which lends itself to the novelty of the valve 10. FIGS. 1A–1G comprise the series of figures showing the operation of the system and the location of the disc valve 10 during lower circulation. As illustrated in the Figures, the travelling disc valve 10 and related components have been positioned below the upper packer, not illustrated, with the crossover tool raised to the lower circulation position. While in this position, the sand slurry, following the packing off process as discussed, is pumped down the tubing, through the crossover ports into the casing annulus 37 below the packer 20, as seen by arrows 21, between the outer casing 36 and the outer assembly 100. The sand slurry flow, would then enter the telltale screen 44, through the plurality of ports 80 in the wall of the screen above the disc valve 10, up the bore 43 of the wash pipe 58 in the direction of Arrows 23, through the concentric passage 82 of the crossover tool and would continue to travel up the passage through the ports which would communicate with the casing annulus above the packer, not illustrated.

Figure 2A:
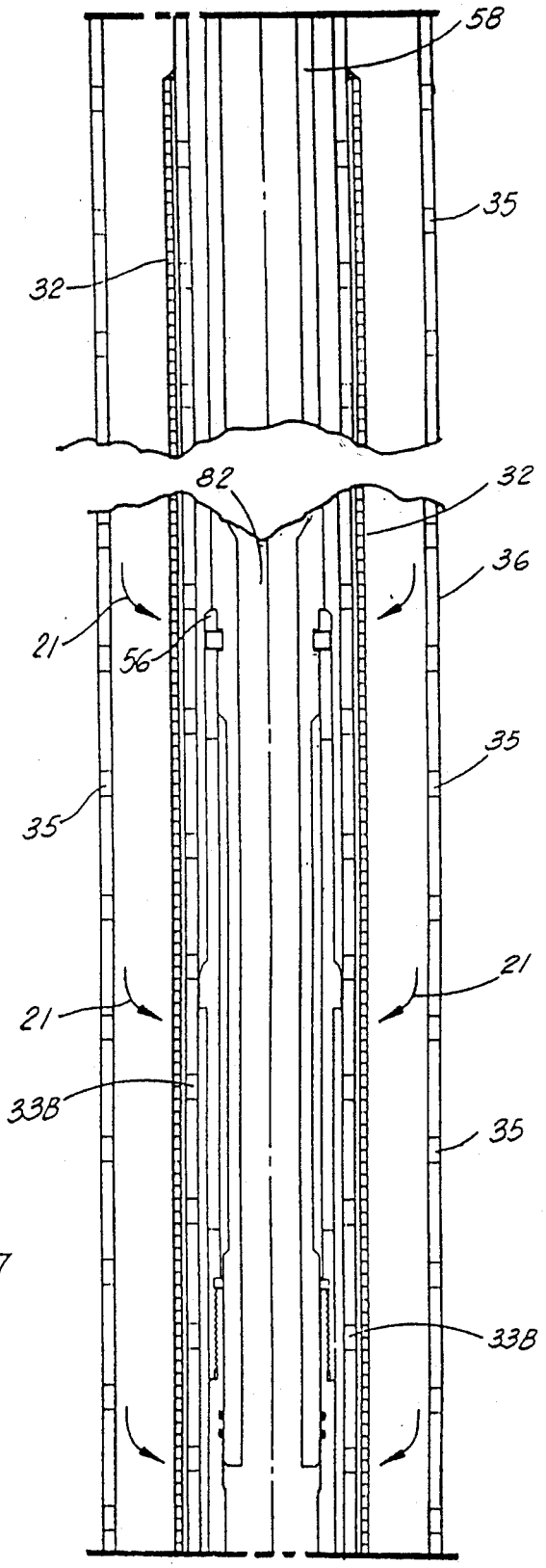
FIGS. 2A through 2D illustrate in cross-section views, the isolated components of the assembly during upper circulation following the raising of the top seal ring out of sealing engagement with the bottom seal bore.
Figure 2B:
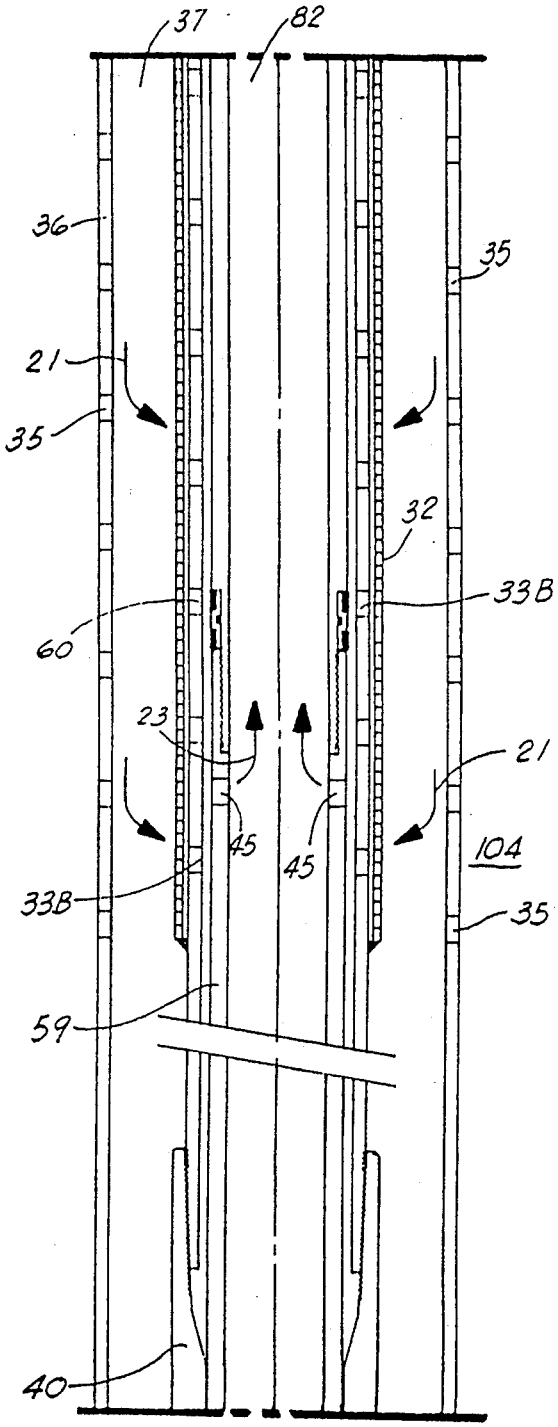
Figure 2C:
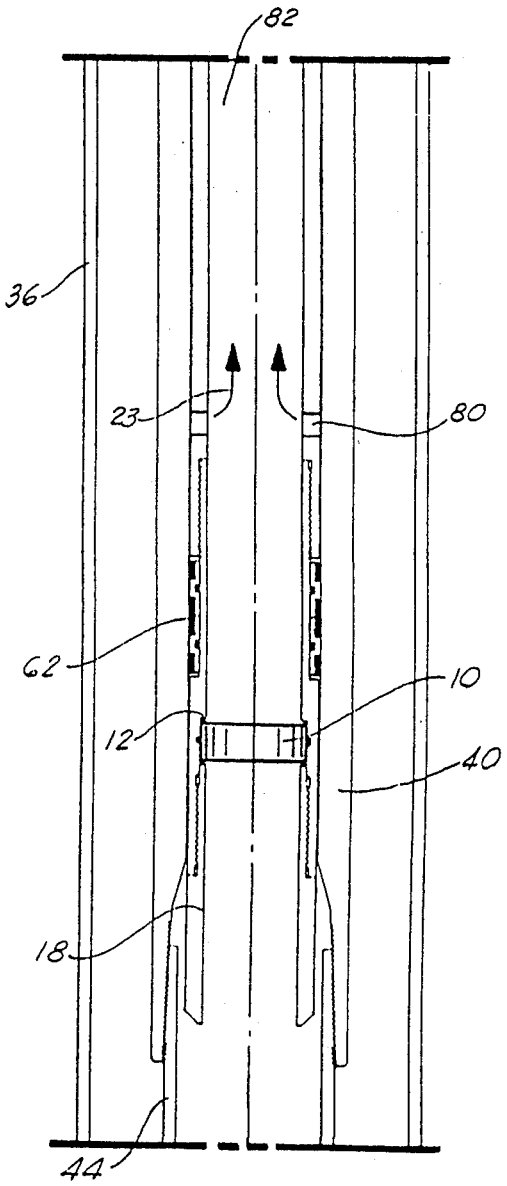
Figure 2D:
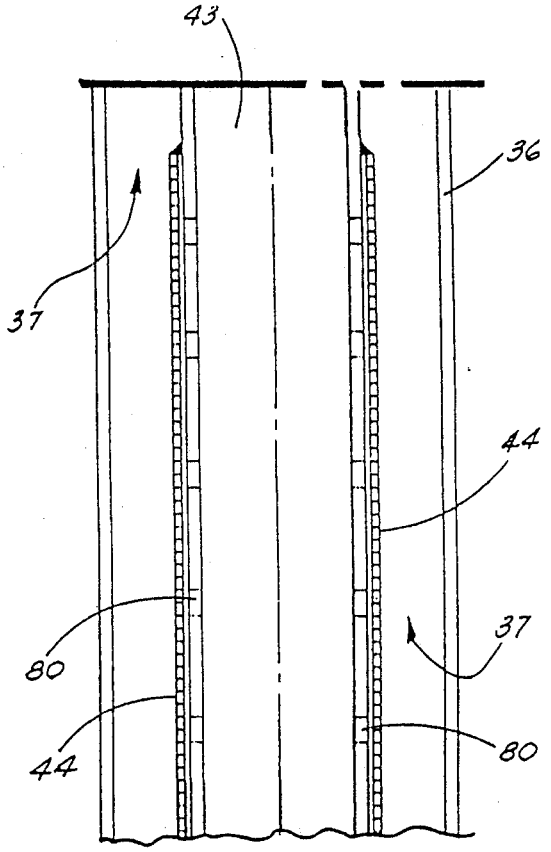

During the lower circulation process as described, the point at which sand has begun to accumulate against the ports in the telltale screen 44, would result in the retardation of the circulation of the fluid as previously described. Therefore, the pump pressure, at the surface would increase, would indicate that the crossover tool as in position as seen in FIGS. 1A through 1G should be raised by raising the wash pipe 44 in the hole, to the position that the first top seal ring 60 would be pulled from the position within the bottom seal bore 40, as seen more clearly in FIGS. 2A and 2D, and in position adjacent production screen 32 and through ports 45 in spacer 59. When this is accomplished in the process, the circulation through the production screen 32 would then be permitted through the ports 33B below the first top seal ring 60, allowing the flow to enter into the wash pipe in the direction of Arrows 23.

As in the earlier part of the process during lower circulation, when the sand has begun to accumulate against the production screen 32, again the pump pressure will increase which will force the sand slurry into the casing perforations 35, and then into the formation 104, surround the casing at the point of the perforations. The pressure would then be released and the crossover tool would then be raised until the crossover ports are above the packer. In this position, the excess sand slurry can then be circulated and returned back to the well surface by pumping down the annulus between the casing 36 and the tubing that extends to the surface of the well above the hydraulic setting tool and crossover tool. The fluid would then be received at the surface of the well through the tubing bore.

Figure 2E:
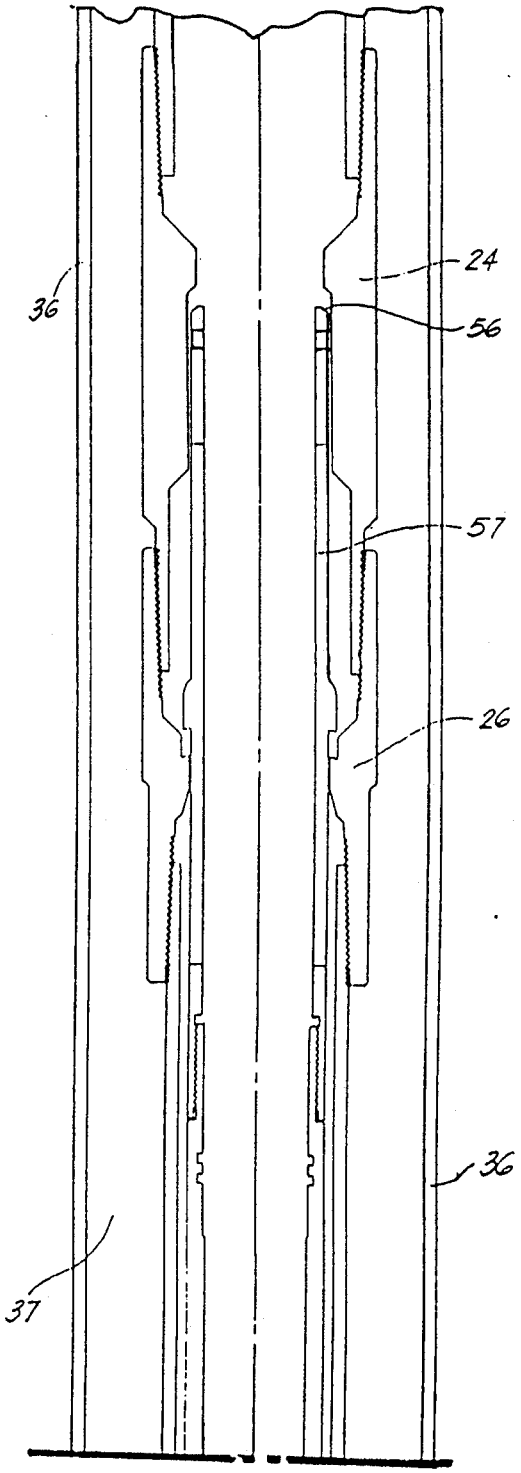
FIGS. 2E through 2G illustrate in cross-section views, the isolated components of the assembly further illustrating the upper section of the assembly after the wash pipe has been sheared and withdrawn from borehole and the disc valve is locked in position.
Figure 2F:
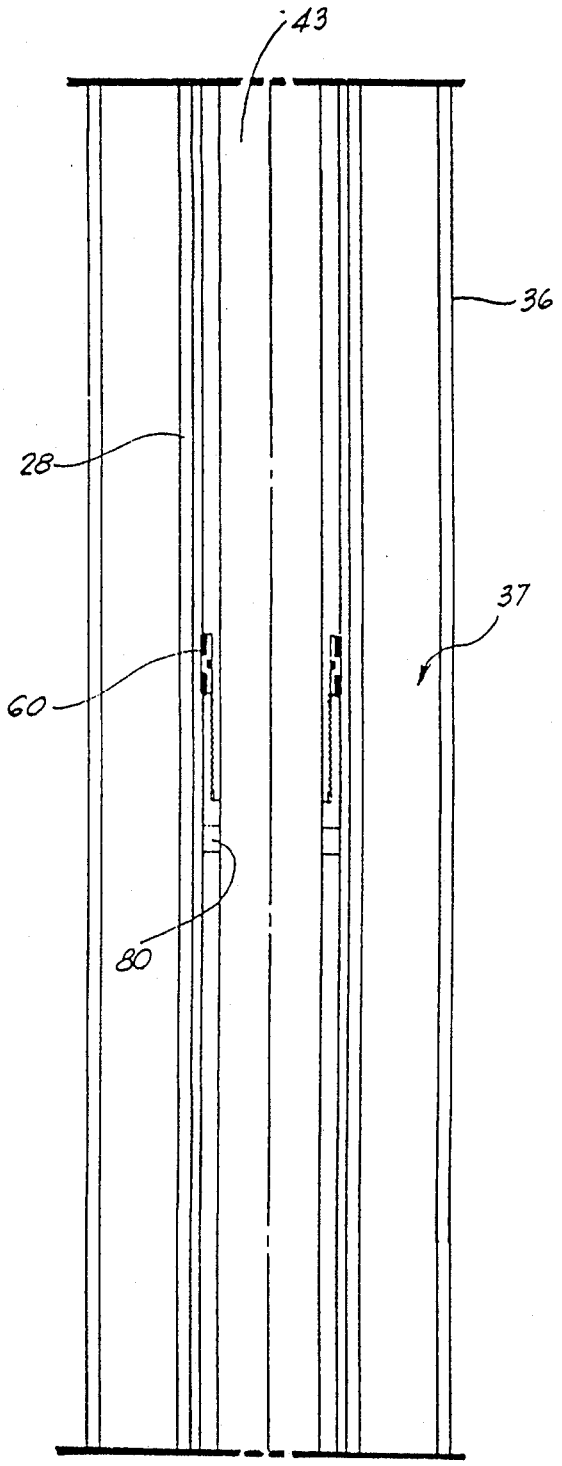
Figure 2G:
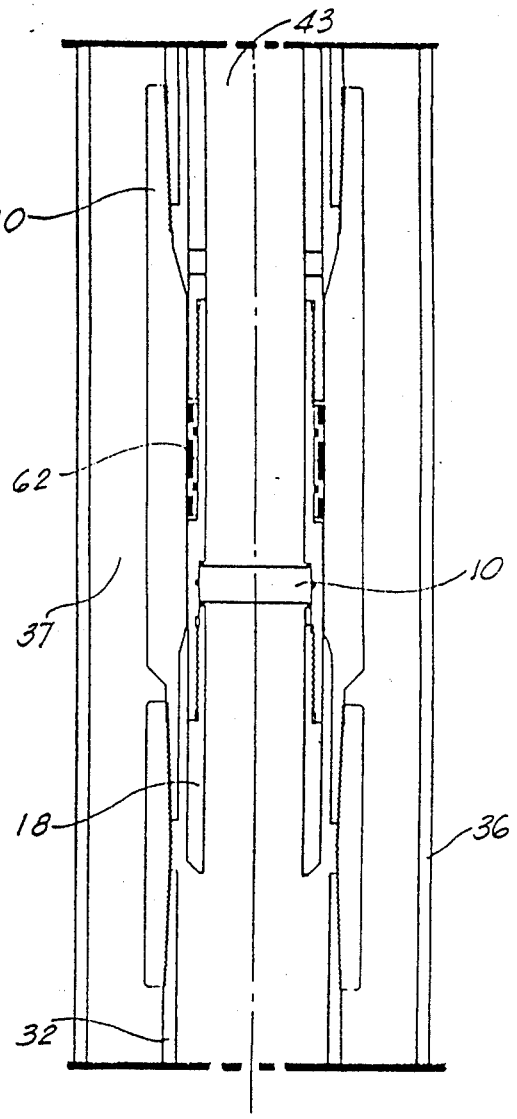

Upon the completion of the reverse circulation as seen and described, again reference is made to FIGS. 2E–2G where it is illustrated that the crossover tool and the wash pipe 44 are raised until the shear joint 56 positioned above the collet 57 is stopped in the top locator 24. At this point, shear screws 56A in the shear joint 56 will be sheared off, leaving the disc valve assembly, comprising the components below the shear joint 56 down to the disc valve 10 held in place by lower end piece 18 of the assembly. In this position, the second bottom seal rings 62 together with disc valve 10 provide a means to prevent fluid flow from entering into the formation from above the disc valve 10, or from preventing fluid or gas production to enter from the surrounding formation. At the point that the shear pins are sheared, the crossover tool and the wash pipe are then withdrawn from the hole, leaving the disc valve assembly as described. Although a shear joint is utilized in this preferred embodiment, any means for disconnecting the disc valve assembly from the wash pipe 44.

Figure 3:
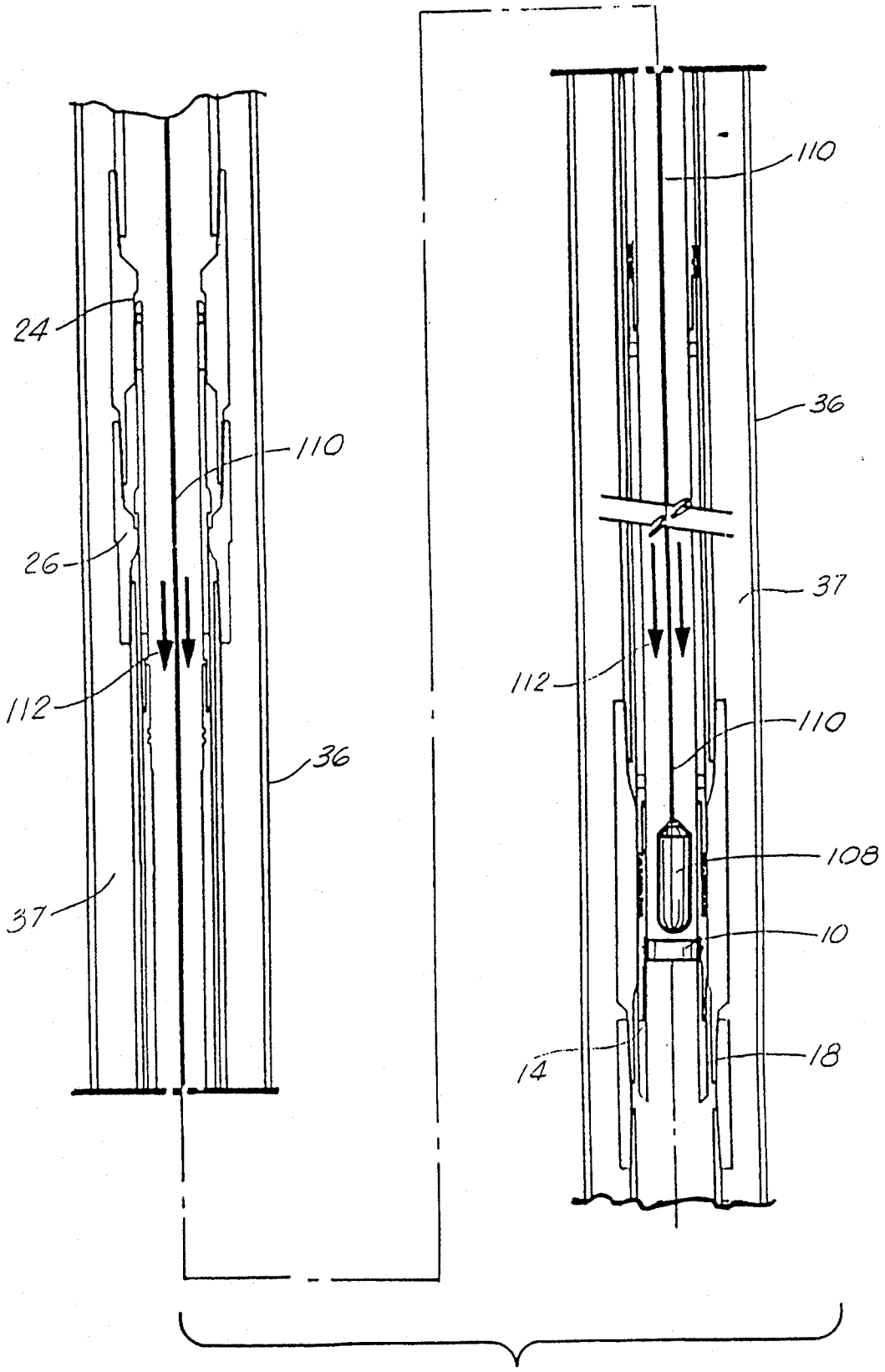
FIG. 3 illustrates a cross-section view of the manner in which the travelling disc valve of the present invention is ruptured and removed to allow flow as illustrated in FIGS. 4A and 4B.
Figure 4A:
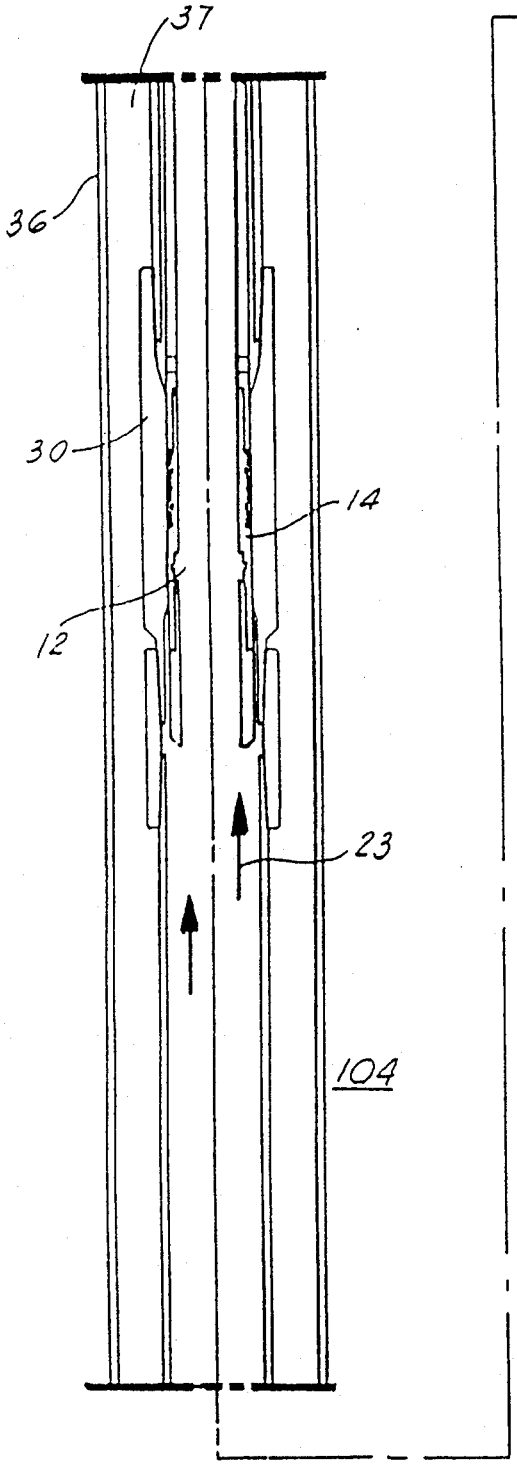
FIGS. 4A and 4B illustrate cross-section views of isolated components of the system utilizing the present invention, with the disc valve ruptured to allow production flow in the system.
Figure 4B:
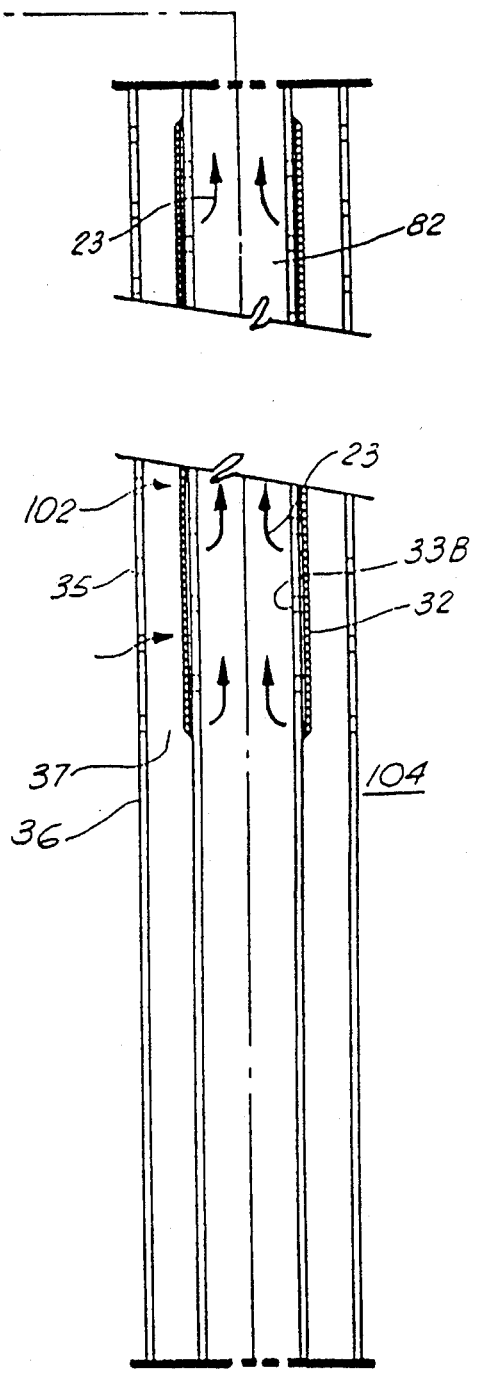

Following the running of the production tubing and the seals into the well and stabbing to secure the packer, the disc valve 10 must be ruptured in order to clear the way for production of the well. Therefore, there is a means to rupture the valve. This means would comprise, preferably, a long, slender, pointed sinker bar 108, as illustrated in FIG. 3, which would be lowered on a wire line 110 through bore 43 in the assembly 102, in the direction of Arrows 112, and by raising and dropping the bar 108 against the glass disc 10, the impact would rupture the disc 10, thus clearing the passage within the assembly 102, in order to allow the well to begin producing through the production screen through the internal bore of the disc valve assembly 102, as seen in FIGS. 4A–4B. In addition, mere fluid pressure in the bore may be used to rupture the disc valve, without the need for a sinker bar or the like.

As seen in those Figures, 4A and 4B illustrate isolated views of the component of the travelling disc valve assembly 102, which illustrates the upper portion of the assembly having the gap 12 where the ruptured disc was once in position, and has been ruptured by the impact of tool 108, as illustrated in FIG. 3. Therefore, as seen, fluid which has traveled through ports 35 in casing 36 into the annular space 37 are then free to enter into production screen 32, through the ports 33B in the production casing, of the concentric passage 82 in the direction of Arrows 23 to be collected at the surface of the assembly. It is at this particular point that the production of the well has commenced, and the upward pressure of the production from the surrounding formation 104 is able to take place.

There is now a discussion of the embodiment of the travelling valve assembly utilizing the travelling isolation pipe. Since a thorough discussion has been offered regarding the original travelling disc valve assembly, the discussion of this particular embodiment will focus on the structure secured to and below the valve assembly 102, and the functioning of that structure. However some discussion of the disc valve structure is required as follows.

Figure 5:
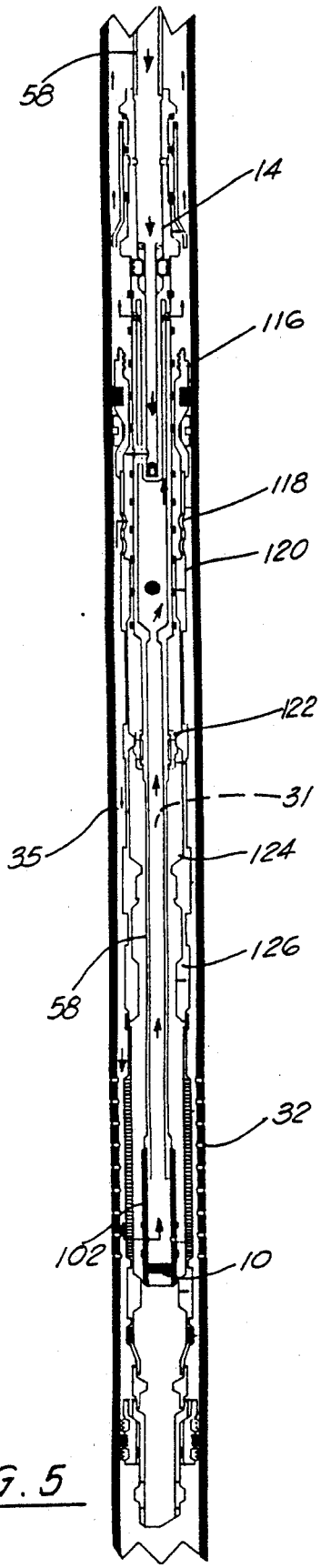
FIGS. 5 through 7 illustrate cross-section overall views of the original embodiment of the travelling disc valve apparatus in the upper circulating position, the position of the disc valve locked in place, and the position when the well is producing, respectively.
Figure 6:
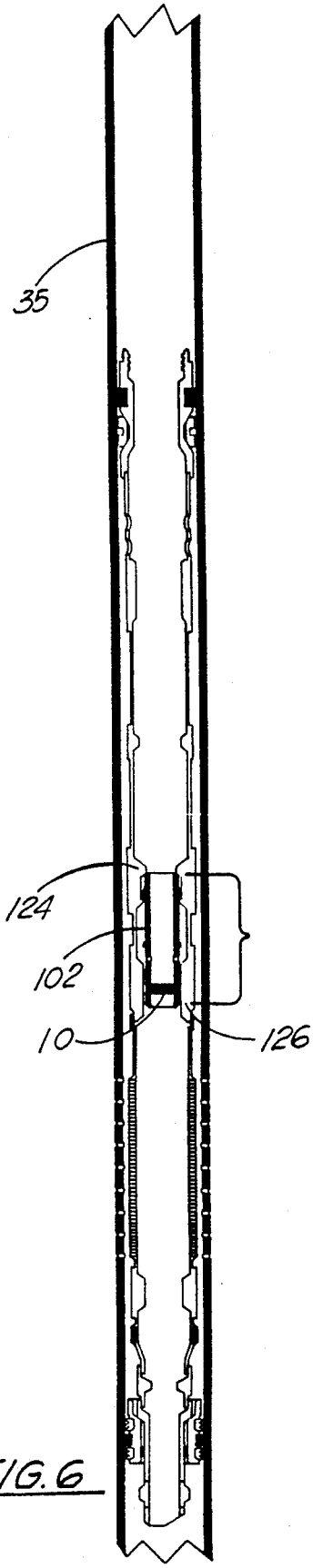
Figure 7:
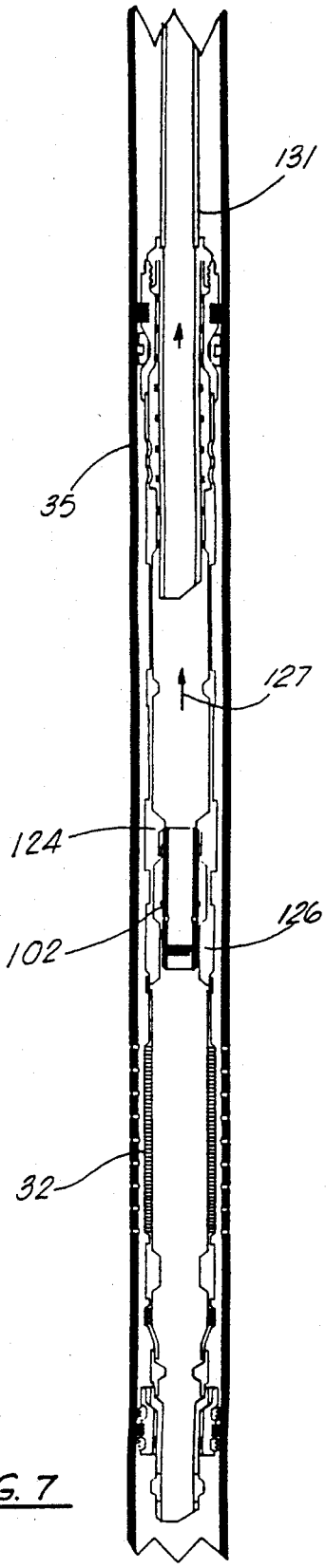

In order to fully appreciate the embodiment of the valve assembly using the travelling isolation pipe, reference is made to FIGS. 5 through 10. FIGS. 5 through 7, however, are cross-section views of the original embodiment of the travelling disc valve assembly 102 as it was positioned in the upper circulating position in FIG. 5. As illustrated, the assembly 102 was connected to a length of wash pipe 58 which positioned it at the level of the production screen 32 so that fluids could be circulated downhole and up through the annulus 31 of the wash pipe 32 to be returned to the surface. In FIG. 6, when production was to commence, the disc valve assembly 102 was pulled upward at the end of wash pipe 32 and engaged within the housing 124 for the disc valve assembly 102 and positioned to seal at the seal bore 126 below the housing 125. The disc valve 10 was sealing off any flow through the assembly 102. In FIG. 7, the disc valve 10 has been ruptured, as described earlier, and the production flow (arrow 127) would commence up the production pipe 131. It should be noted that once flow is commenced the disc valve in the original embodiment cannot be restored, and the production zone 127 cannot be re-isolated.

Figure 8:
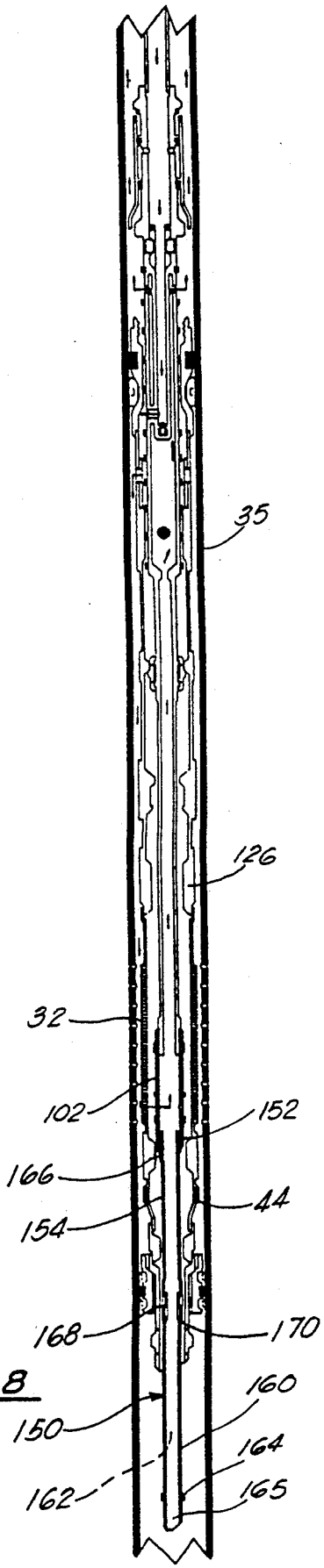
FIGS. 8 through 10 illustrate cross-section overall views of the embodiment of the travelling isolation pipe valving apparatus in the upper circulating position, the position of the isolation pipe sealing off the production zone, and the position when the well is producing, respectively.
Figure 9:
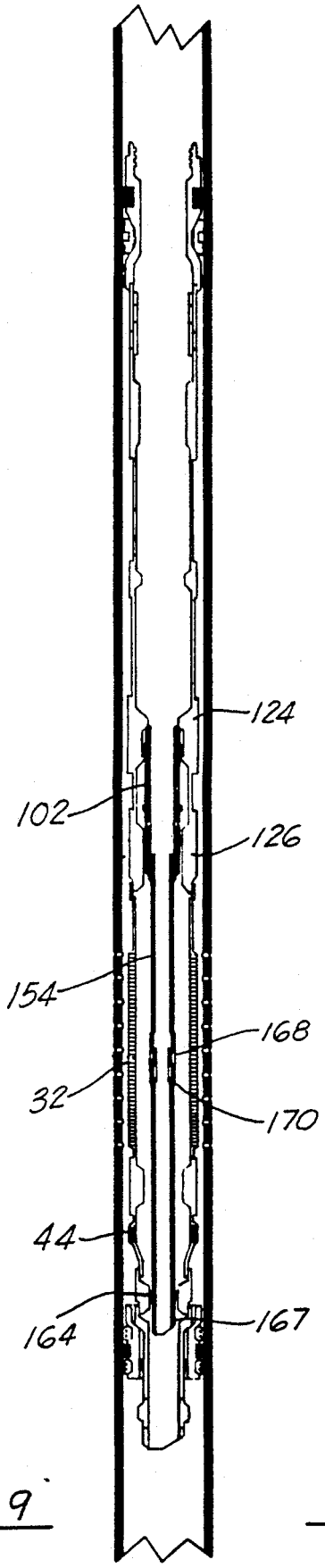
Figure 10:
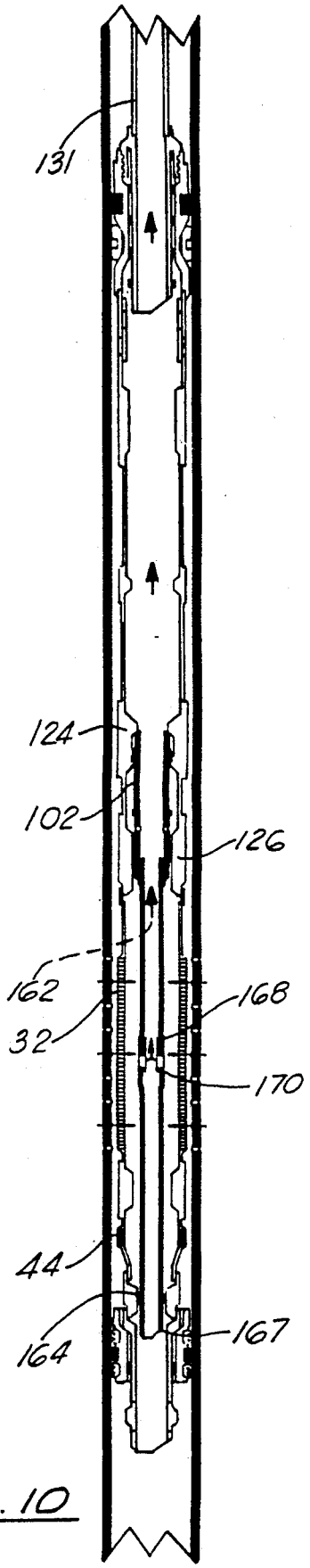

Therefore, there is provided in FIGS. 8 through 10 the embodiment of the valving assembly 102 using the travelling isolation pipe means 150. As seen in FIG. 8, isolation pipe means 150 is connected onto the lower portion of the disc valve assembly 102 through shear pins 152 or the like. As seen in the figure, the travelling isolation pipe means 150 comprises the assembly portion 102 and the isolation pipe member 154 engaged thereon. In FIG. 8, the valve assembly 102 with the isolation pipe 154 secured thereto is in the same position as the valve assembly that is seen in FIG. 5, so as to allow upper circulation through the production screen 32.

For purposes of construction, isolation pipe means comprises a length of tubing 160 having a bore 162 therethrough for allowing production flow up the bore 162 of the pipe 160. Further, tubing 160 would be provided with a sealing means 164, such as a gasket, around the outer surface of the lower end 165 of tubing 160 to seal as will be described further. In addition, along its wall surface, there is provided a valving means 168, such as a sliding door valve 170, for opening and closing flow through the tubing 160. The pipe would be of sufficient length so that when lowered to its position for production to commence, the upper end 166 of the tubing 160 would be above the production screen 32 and the lower end 165 of the tubing 160 would be below both the production screen and the telltale screen 44. The reason for this, is that during production, the upper end of the isolation pipe must extend connected to the valve housing 102 which seats in the seal bore 126 and seals off flow, and the must seal off any flow into the bore of the assembly below the lower end of the isolation pipe 154.

As seen in FIG. 9, the assembly 102 has been raised and seated within the valve housing 124, and seal bore 126 and has been disconnected from the wash pipe 32. The wash pipe 32 has been pulled from the hole. At this position in FIG. 9, the isolation pipe 154 suspended from the assembly 102 is extending down below the production screen 32 and telltale screen 44 and with lower seal member 164 is sealing at lower seal bore 167. In this position, the valving means 168, which is preferably a sliding side door valve 170, is in the closed position, and production flow is isolated from moving upward to the surface, or down below the lower end 165 of isolation pipe 154.

In FIG. 10, production is commencing, therefore, the sliding side door valve 170 is placed to the open position, through lowering a wire line shifting tool or the like to manually open the valve, and the production from the formation is allowed to flow into the flow ports 33B in the production screen 32, through the open side door valve 170, and up the annulus 162 of the isolation pipe 154, to the surface. This embodiment of the invention accomplishes the same as the rupturable disc valve and more. Utilizing the isolation pipe 154 attached to the valve assembly 102, following the depletion of the production zone, the valve 170 may be reclosed, and the formation is once more isolated. Therefore, formations above and below this isolated formation may be worked. In addition, since the isolation pipe 154 has a continuous bore, tools or the like can be working below the isolation pipe, and debris, which may normally be trapped, can fall to the area below the sump packer.

Although FIGS. 8 through 10 illustrate that a section isolation pipe 154 is connected to the assembly 102, it is foreseen that the wash pipe 58 which has been removed from the hole after the assembly 102 has been locked in place, as seen in FIG. 7, could be extended downward beyond the screen 32, and therefore serve the same purpose as isolation pipe 154. Of course, in order to have any production flow through screen 32 of the borehole, one would have to modify the wall of wash pipe 58 with a valving mechanism 168, as illustrated in FIGS. 8 through 10, or the wall of the wash pipe could be perforated with a mechanical perforator as will be described more fully making reference to FIGS. 11 and 12.

Figure 11:
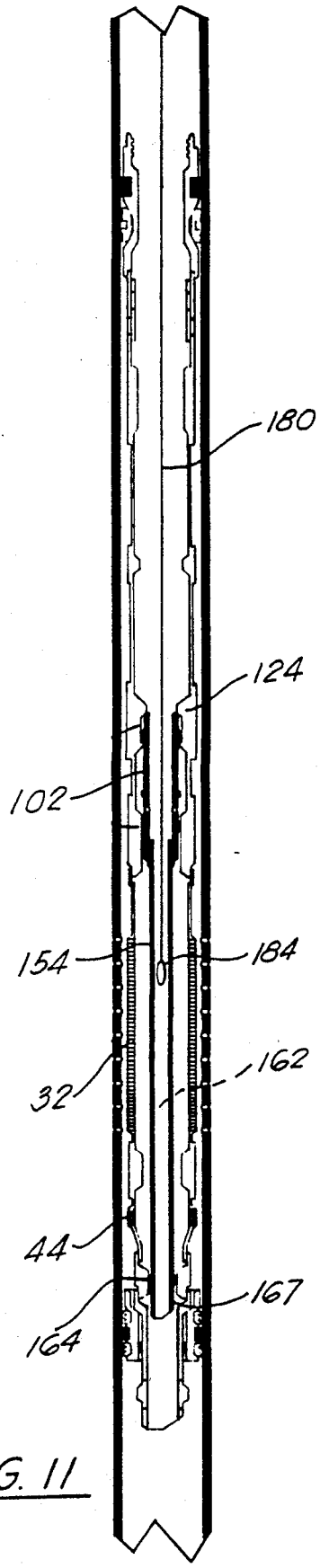
FIG. 11 illustrates a cross-sectional overall view of an additional embodiment of the travelling isolation pipe sealing off from the production zone within the casing.
Figure 12:
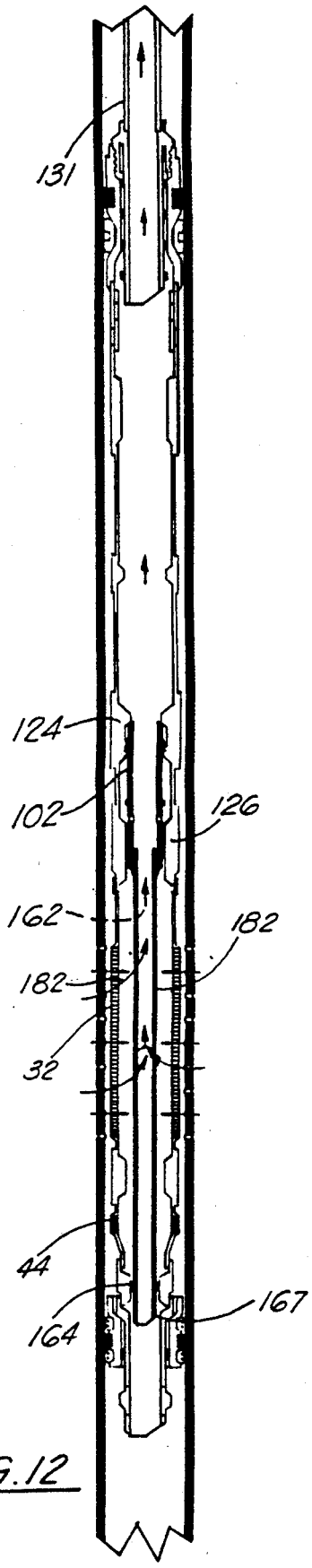
FIG. 12 illustrates in cross-sectional overall view the additional embodiment of the travelling isolation pipe whereby a mechanical perforator has been lowered down a wire line and is perforated the wall of the isolation pipe to allow production to commence through the perforated wall.

An additional embodiment of this concept is illustrated in FIGS. 11 and 12. As illustrated, assembly 102 has attached to it section of isolation pipe 154, Which does not include a valving mechanism 168, as is illustrated in FIGS. 8 through 10. Therefore, there would be a continuous wall along the length of isolation pipe 154 as seen in FIG. 11. In order to provide for flow of the isolation pipe, FIG. 11 illustrates that a wire line 180 has been lowered through the bore 162 of isolation pipe 154, and there is provided a mechanical perforator 184, which is known in the art, and has the ability to mechanically perforate the wall of the isolation pipe at a predetermined point. Therefore, as seen in FIG. 11, the mechanical perforator 184 has been set in place, and after the wall of the pipe has been perforated by the perforator 184, and the perforation withdrawn, production flow through screen 32, perforations, (arrows 182), and is allowed to flow up bore 162 of isolation pipe and hence up the production casing 131 as illustrated. Therefore, rather than having a valving mechanism 168 in the wall of the pipe, the perforator 184 would in effect undertake the same function. The only difference in this embodiment is that once the perforations are in place in the wall of the isolation pipe 154, the ports of course cannot be "closed" as with the closing of the valve 168.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved travelling valve assembly utilizing an isolation pipe, for allowing production flow to the surface, the assembly comprising:

a) a length of tubing lowered down a cased well bore;

b) a valve assembly secured to the tubing and positioned to a lower circulation position in the well bore;

c) an isolation pipe member suspended from the valve assembly, including a lower seal;

d) valving means positioned in the wall of the isolation pipe member movable between open and closed positions;

e) means in the valve assembly for severing the valve assembly from the tubing when the valve assembly is moved to an upper position, so that the isolation pipe is sealing off production flow up the production string; and f) means for opening the valving means in the isolation pipe member for allowing production flow from the surrounding formation, and up the production string.

2. The valve assembly in claim 1, wherein there is further provided a telltale screen for allowing initial circulation of gravel pack slurry.

3. The valve assembly in claim 1, wherein the assembly is placed in a first position below the telltale screen, to allow for gravel pack operation.

4. The valve assembly in claim 1, wherein the means for severing the valve assembly from the tubing comprises a no-go housing which engages and secures the valve assembly while the tubing is continued to be pulled from the hole.

5. The valve assembly in claim 1, wherein the means for opening the valving means further comprises a wire line lowered into the hole.

6. The valve assembly in claim wherein the production from the formation flows through the production screen and through the valving means.

7. The valve assembly in claim 1, wherein the valving means comprises a sidewall sliding valve.

8. An improved travelling valve assembly utilizing an isolation pipe, for allowing production flow to the surface, the assembly comprising:

a) a length of tubing lowered down a cased well bore;

b) a valve assembly secured to the tubing and positioned to a lower circulation position in the well bore;

c) an isolation pipe member suspended from the valve assembly, including a lower seal;

d) a sidewall sliding valve positioned in the wall of the isolation pipe member movable between open and closed positions;

e) means in the valve assembly for severing the valve assembly from the tubing when the valve assembly is moved to an upper position, so that the isolation pipe is sealing off production flow up the production string; and f) means for opening the sliding sidewall valve in the isolation pipe member for allowing production flow from the surrounding formation, and up the production string.

9. An improved assembly for allowing production flow to the surface, the assembly comprising:

a) a length of tubing lowered down a cased well bore;

b) an assembly secured to the tubing and positioned to a lower circulation position in the well bore;

c) an pipe member suspended from the assembly, including a lower seal;

d) means in the assembly for severing the assembly from the tubing when the assembly is moved to an upper position, so that the pipe member suspended from the assembly is sealing off production flow up the production string; and e) means for forming an opening in the wall of the pipe member suspended from the assembly for allowing production flow from the surround formation, and up the production string.

10. The assembly in claim 9, wherein the means for forming an opening in the wall of the pipe suspended from the assembly may further comprise a valving member in the wall of the pipe, or a mechanical perforator lowered into the bore of the pipe, and perforating the wall of the pipe for allowing production to commence.

11. The assembly in claim 9, wherein the mechanical perforator is lowered down the bore via a wire line.

12. An improved assembly for allowing production flow to the surface, the assembly comprising:

a) a first length of tubing lowered down a cased well bore;

b) an assembly secured to the tubing and positioned to a lower circulation position in the well bore;

c) a second length of tubing suspended from the assembly, including a lower seal;

d) means in the assembly from the first length of tubing when the assembly is moved to an upper position, so that the second length of tubing remains suspended from the assembly and sealing off production flow up the production string; and e) means for forming an opening in the wall of the second length of tubing suspended from the assembly for allowing production flow from the surrounding formation, and up the production string.

13. The assembly in claim 12, wherein the means for forming an opening in the wall of the second length of tubing suspended from the assembly may further comprise a valving member in the wall of the second length of tubing, or a mechanical perforator lowered into the bore of the second length of tubing, and perforating the wall of the tubing for allowing production to commence through the perforations in the tubing.

* * * * *